US007695083B2

(12) United States Patent
Zhang

(10) Patent No.: US 7,695,083 B2
(45) **Date of Patent: *Apr. 13, 2010**

(54) PRINTING APPARATUS AND METHOD OF DETERMINING AMOUNT OF PRINTING MATERIAL

(75) Inventor: Junhua Zhang, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 403 days.

This patent is subject to a terminal disclaimer.

(21) Appl. No.: 11/737,278

(22) Filed: Apr. 19, 2007

(65) Prior Publication Data

US 2007/0247481 A1 Oct. 25, 2007

(30) Foreign Application Priority Data

Apr. 19, 2006 (JP) ..... 2006-115482

(51) Int. Cl.
*B41J 2/195* (2006.01)
*B41J 29/393* (2006.01)
*B41J 2/175* (2006.01)

(52) U.S. Cl. ..... 347/7; 347/19; 347/86; 73/290 V

(58) Field of Classification Search ..... 347/19, 347/86, 7; 73/290 V

See application file for complete search history.

(56) References Cited

U.S. PATENT DOCUMENTS 6,470,744 B1 * 10/2002 Usui et al. ..... 73/290 R

FOREIGN PATENT DOCUMENTS

JP 2003-039707 2/2003

* cited by examiner

*Primary Examiner*—Julian D Huffman
(74) *Attorney, Agent, or Firm*—Workman Nydegger

(57) ABSTRACT

A printing apparatus to which a printing material container is detachably mounted, the printing material container having a piezoelectric element for detecting the amount of material stored in the container and a memory unit storing the natural vibration frequency of the piezoelectric element, the printing apparatus comprising means for acquiring the frequency information from the memory unit, means for generating a drive having a first signal waveform at a first frequency and a second signal waveform at a second frequency different from the first frequency, means for selectively supplying either the first or second signal waveform to the piezoelectric element so as to increase the amplitude of the vibrations of the piezoelectric element; means for detecting a response signal, means for measuring the vibration frequency contained in the response signal, and means for determining the amount of material stored in the printing material container based on the measured vibration frequency.

8 Claims, 12 Drawing Sheets

REMAINING INK

NO INK REMAINING

REMAINING INK

NO REMAINING INK

FIG. 9

| CHARACTERISTIC FREQUENCY fF | SELECTED PATTERN | | SD1 |
|---|---|---|---|
| | SP1 | SP2 | |
| fF > Hm | ○ | × | 1 0 |
| fF ≤ Hm | × | ○ | 0 1 |

PRINTING APPARATUS AND METHOD OF DETERMINING AMOUNT OF PRINTING MATERIAL

BACKGROUND OF THE INVENTION

The entire disclosure of Japanese Patent Application No. 2006-115482, filed Apr. 19, 2006 is expressly incorporated herein by reference.

1. Technical Field

The present invention relates to a printing apparatus. More specifically, the present invention relates to a method of detecting the amount of a printing material in a printing material storage container.

2. Related Art

Many ink jet printing apparatuses contain a printing material storage container which includes a sensor for detecting the amount of remaining printing material in the container. One example of a sensor is a piezoelectric element which has the ability to expand and contract upon application of a voltage. The piezoelectric element oscillates upon application of the voltage and outputs an output signal. Thus, the printing apparatus applies the voltage to the piezoelectric element and measures the oscillation frequency of the piezoelectric element contained in the output signal to determine whether or not a predetermined amount of printing material remains in the printing material storage container.

Typically, the frequency of the voltage applied to the piezoelectric element is adjusted to be a resonant frequency of the sensor and the printing material stored in the printing material storage container, so that the amplitude of the oscillation of the piezoelectric element is increased and oscillation frequency measurement is more accurate.

Often, however, the sensors contain manufacturing errors generated during the manufacturing process. Often, the amplitude of the oscillation of the piezoelectric element may be reduced according to the manufacturing errors of the sensors, while the drive signal which is used to drive the sensors are constant. This makes the measurement of the oscillation frequency of the piezoelectric element difficult to measure with a high degree of accuracy, that the output signals outputted from the sensors may differ even though the same amount of printing material remains in the printing material storage container. Consequently, there is currently a problem accurately measuring the amount of printing material stored in the printing material storage container.

BRIEF SUMMARY OF THE INVENTION

In order to solve at least part of the problems shown above, one aspect of the invention provides a printing apparatus configured to measure the amount of the printing material stored in the printing material storage container. Further, one advantage of the invention is a more accurate measurement of the amount of printing material stored in a printing material storage container.

The printing apparatus of the invention comprises an acquiring unit capable of acquiring frequency information from a memory, a drive signal generating unit capable of generating and outputting a drive signal which may be used for driving a piezoelectric element which has a first signal waveform at a first frequency and a second signal waveform at a second frequency which is different from the first frequency, a supply unit capable of selecting a waveform which increases the amplitude of oscillations of the piezoelectric element from the first signal waveform and the second signal waveform of the outputted drive signal based on frequency information and supplying a selected drive signal having the selected signal waveform to the piezoelectric element, a detecting unit capable of detecting a response signal which is outputted in association with the oscillation of the piezoelectric element after having stopped the supply of the selected drive signal, a measuring unit configured to measure the oscillation frequency of the piezoelectric element included in the response signal, and a determining unit configured to determine the amount of the printing material stored in the printing material storing container on the basis of the oscillation frequency.

One advantage of the present invention is that the residual oscillation of the piezoelectric element is excited effectively using only one drive signal. Therefore, since it is no longer necessary to generate a drive signal for each printing material storage container, the processing load and processing time of the printing apparatus is reduced. Furthermore, the present invention is capable of detecting the response signal more accurately, resulting in a more accurate measurement of the amount of the printing material in the storage container.

BRIEF DESCRIPTION OF THE DRAWINGS

The invention will be described with reference to the accompanying drawings, wherein like numbers reference like elements.

FIG. 9 is an explanatory drawing showing an example of switch control data according to the first example.

DETAILED DESCRIPTION OF THE PREFERRED EMBODIMENTS

Figure 1:
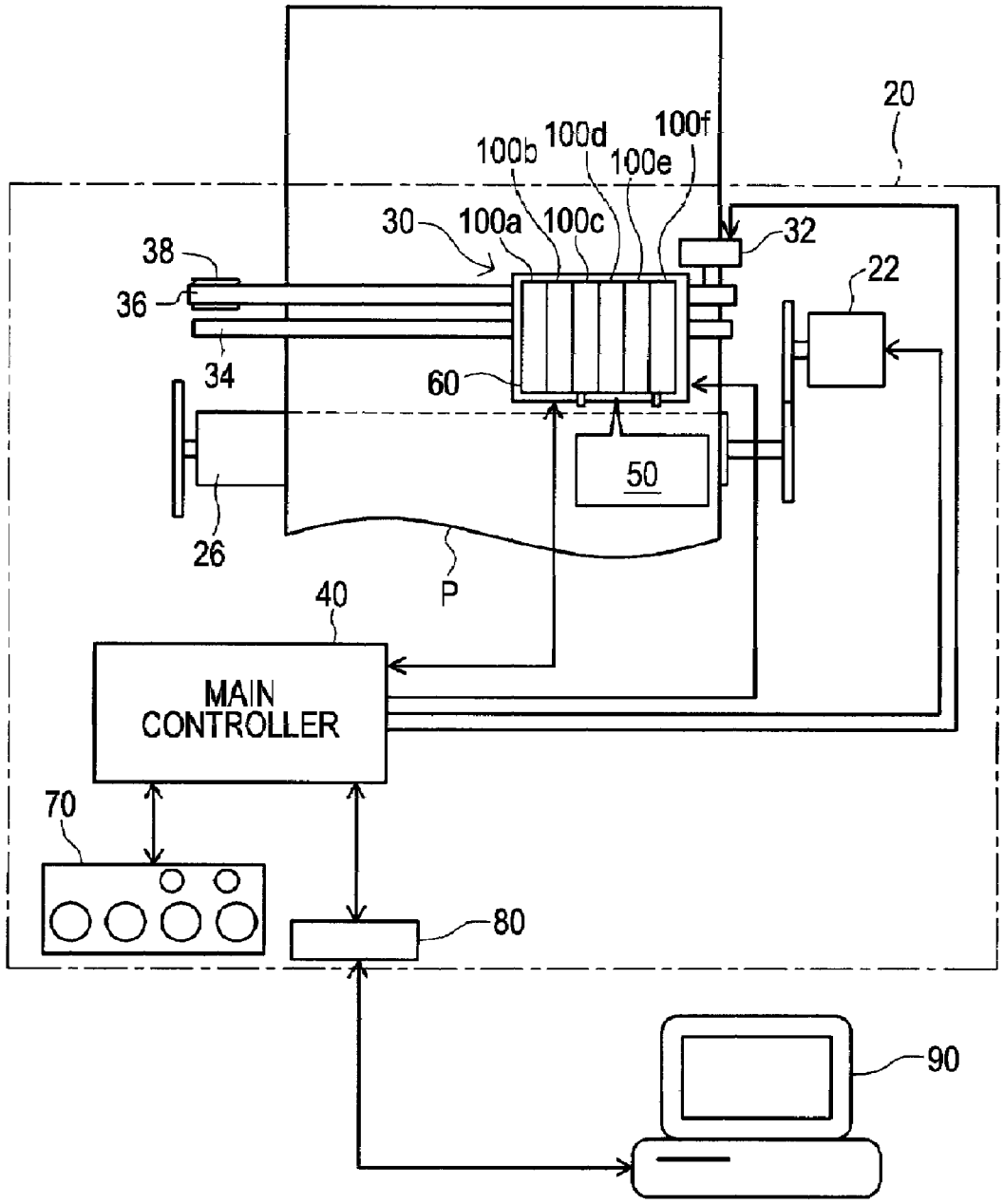
FIG. 1 is an exemplary schematic configuration of a printing system.

Referring now to the drawings, the invention will be described using a series of examples listed below.

A. First Example

A1. System Configuration

FIG. 1 is a schematic configuration of an exemplary printing system. The printing system includes a printer 20 and a computer 90. The printer 20 is connected to the computer 90 via a connector 80.

The printer 20 includes a secondary scan feeding mechanism, a main scan feeding mechanism, a head control mechanism, and a main controller 40 for controlling the respective mechanisms. The secondary scan feeding mechanism includes a paper feed motor 22 and a platen 26. The secondary scan feeding mechanism transports paper P by transmitting the rotation of the paper feed motor to the platen in the secondary scanning direction. The primary scan feeding mechanism includes a carriage motor 32, a pulley 38, a drive belt 36 tightly extended between the carriage motor 32 and the pulley 38, and a sliding shaft 34 placed parallel to the platen shaft 26. The sliding shaft 34 holds a carriage which is fixed to the drive belt 36 in a manner that allows the carriage to slide along the sliding shaft 34. The rotation of the carriage motor 32 is transmitted to the carriage 30 via the drive belt 36. The carriage 30 moves reciprocally along the axial direction (primary scanning direction) of the platen 26 via the sliding shaft 34. The head control mechanism includes a printing head unit 60 mounted to the carriage 30. The head control mechanism causes the printing head 69 to discharge ink on the paper P. The printer 20 further includes an operating unit 70 which allows the user to select various settings and confirm the status of the printer.

The printing head unit 60 includes a print head 69 and a cartridge mounting portion. The cartridge mounting portion accommodates six ink cartridges 100*a* to 100*f*. The printing head unit 60 further includes a sub-controller 50.

The print head 69 includes a plurality of nozzles and a plurality of piezoelectric elements, and discharge ink drops from the respective nozzles according to the voltage applied to the respective piezoelectric elements to form dots on the paper P.

The ink cartridges 100*a* to 100*f* each are provided with a sensor which includes a piezoelectric element. The printer 20 supplies a drive signal to the piezoelectric elements of the sensors. The printer 20 determines the amount of ink stored in the ink cartridges by measuring the oscillation frequencies of the piezoelectric elements which is included in the response signals that are outputted from the piezoelectric elements, compared to the residual oscillations generated in the piezoelectric elements after the drive signal is stopped. Hereinafter, the ink cartridge is referred simply to as "cartridge."

A2. Circuit Configuration of Printer

Figure 2:
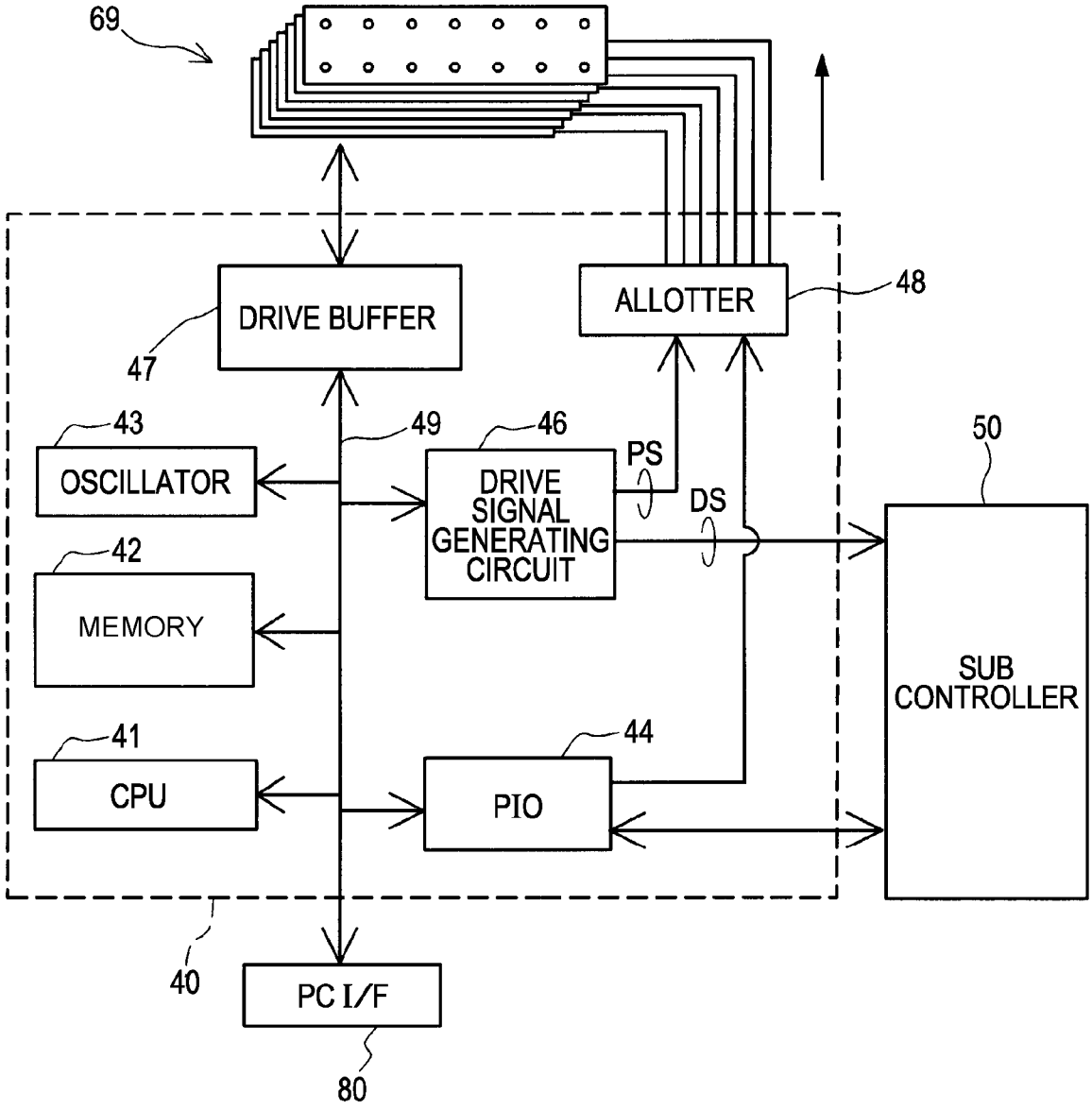
FIG. 2 is an exemplary illustration of a main controller.
Figure 3:
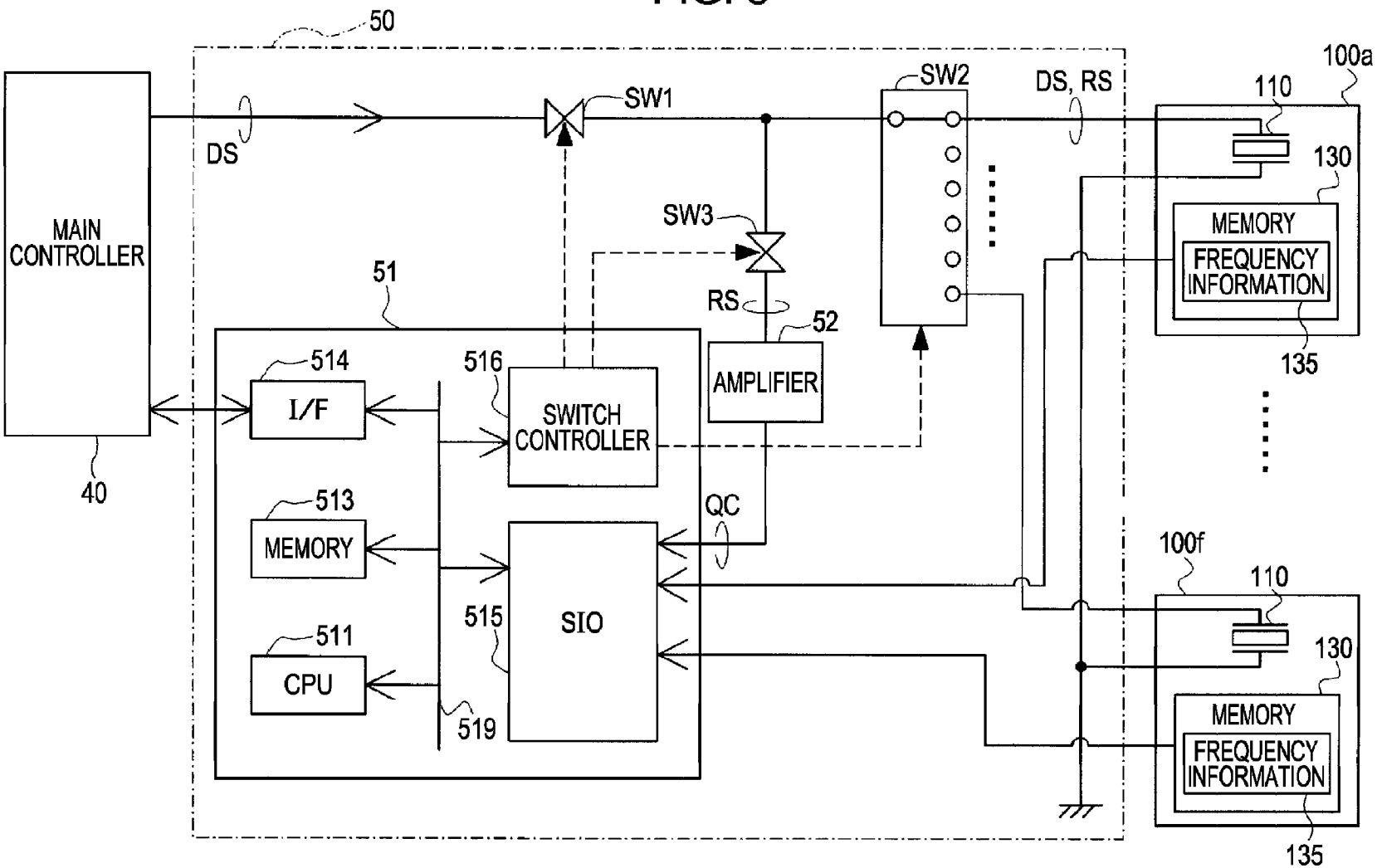
FIG. 3 is an explanatory drawing showing an electric configuration of a sub-controller and a cartridge according to the first example.
Figure 4:
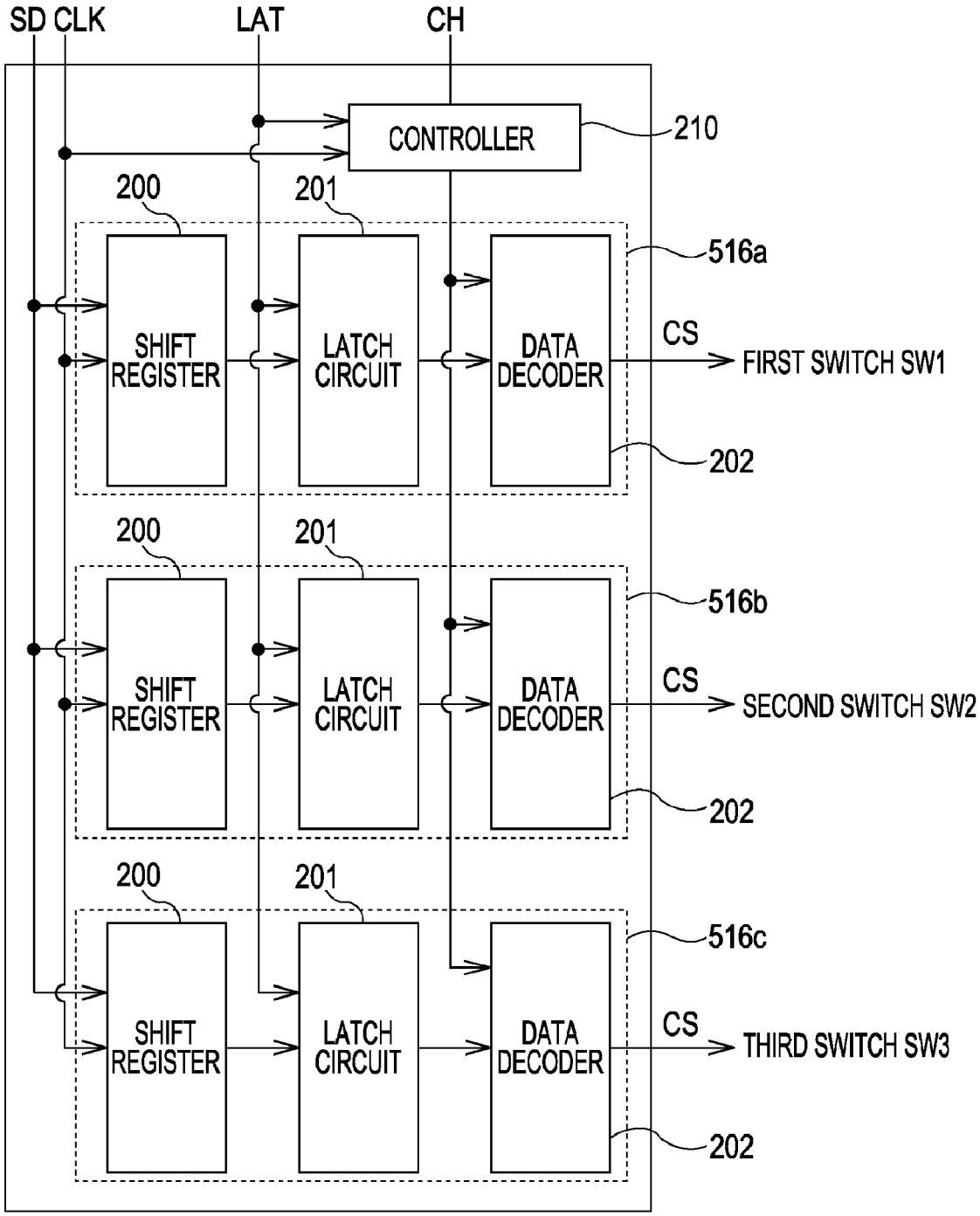
FIG. 4 is an explanatory drawing showing an example of a functional block of a switch controller according to the first example.

Referring now to FIGS. 2-4, a circuit configuration of the printer 20 will be described. FIG. 2 is a drawing illustrating an exemplary electrical configuration of the main controller 40. FIG. 3 is a drawing illustrating an exemplary electric configuration of the sub-controller 50 and a cartridge. FIG. 4 is a block diagram illustrating the switch controller.

The main controller 40 includes a CPU 41, a memory 42, an oscillator 43 configured to generate clock signals, an input and output unit (PIO) 44 configured to transmit signals between peripheral devices and transmit information to the sub-controller 50, a drive signal generating circuit 46, a drive buffer 47, and an allotter 48. These components are connected via buses 49. The busses 49 are also connected to a connector 80, and the main controller 40 is connected to the computer 90 via the busses 49 and the connector 80. Within this configuration, the above-described components are capable of exchanging data.

The drive buffer 47 is used as a buffer for supplying dot ON and OFF signals to the print head 69. The allotter 48 allots drive signals from the drive signal generating circuit 46 to the print head 69 at predetermined times.

The drive signal generating circuit 46 generates head drive signals PS, which are supplied to the print head 69 via the allotter 48, along with drive signals DS which are supplied to the piezoelectric elements 112 via the sub-controller 50. Hereinafter, the term "drive signal" is a "sensor drive signal." The drive signal generating circuit 46 outputs the drive signal DS via the sub-controller 50. The drive signal DS has a first signal waveform at a frequency F1 and a second signal waveform at a frequency F2 which is different from the frequency F1. In this example, the first signal waveform and the second signal waveform are generated so as to be arranged in series, and are outputted in sequence from the drive signal generating circuit 46.

The CPU 41 acquires frequency information 135 (shown in FIG. 3) stored in the memory 42 from the sub-controller 50.

The CPU 41 generates a first switch control data SD1 for selecting either the first signal waveform SP1 or the second signal waveform SP2, based on the acquired frequency information 135, and supplies a drive signal having only the selected signal waveform to the piezoelectric elements. Hereinafter, the drive signal having only the selected signal waveform is referred to as the "selected drive signal." The CPU 41 sends the generated first switch control data SD1 to the sub-controller 50. The first switch control data SD1 is data for controlling a first switch SW1. The CPU 41 generates second switch control data SD2 for controlling a second switch SW2 and third switch control data SD3 for controlling a third switch and sends the same to the sub-controller 50. The switch control data SD will be described in detail later.

The sub-controller 50 is a circuit for executing a process relating to the cartridges 100*a* to 100*f* in cooperation with the main controller 40. FIG. 3 the shows the portions of the circuit which are used during the ink measuring process. The sub-controller 50 is provided with a calculator 51, the three switches SW1 to SW3, and an amplifier 52.

The calculator 51 includes a CPU 511, a memory 513, an interface ("I/F") 514, an I/O portion ("SIO") 515 for transmitting signals between the components in the sub-controller 50 and the cartridges 100*a* to 100*f*, and a switch controller 516. The respective components of the main controller 40 are connected via basses 519. The calculator 51 receives signals from the main controller 40 via the interface 514. The calculator 51 controls the three switches SW1 to SW3 via the switch controller 516. The calculator 51 transmits output from the amplifier 52 via the SIO 515.

The switch controller 516 controls the first switch SW1 to the third switch SW3 according to the switch control data SD. The detailed functional blocks of the switch controller 516 will be described in reference to FIG. 4.

As shown in FIG. 4, the switch controller 516 includes a controller 210, and switch control signal output circuits 220*a*, 220*b* and 220*c* which are configured for each switch. The switch control signal output circuit 220*a* is connected to the first switch SW1 and controls the connecting state of the first switch SW1. The switch control signal output circuit 220*b* is connected to the second switch SW2 and controls the connecting state of the second switch SW2. The switch control signal output circuit 220*c* is connected to the third switch SW3 and controls the connecting state of the third switch SW3. Each of the switch control signal output circuits 220*a* to 220*c* include a shift register 200, a latch circuit 201, and a data decoder 202.

Clock signals CLK, latch signals LAT, change signals CH, and switch control data SD are each supplied from the CPU 41 to the switch controller 516. The switch control data SD is transferred to the shift register 200 synchronously with the clock signals CLK from the oscillator 43 of the main controller 40. The transferred switch control data SD is latched once by the latch circuit 201. The latched switch control data SD is entered to the data decoder 202.

The controller 210 receives input of the latch signals LAT and the change signals CH. The controller 210 generates the switch control signal CS for ON and OFF, controlling the switch on the basis of the latch signals LAT and the change signal CH. The switch control signal CS which is generated by the controller 210 is supplied to the data decoder 202. The data decoder 202 outputs the switch control signal CS to the switch on the basis of the latched switch control data SD. The switch control signal CS will be described in greater detail below.

The first switch SW1 is a one-channel analog switch. One of the terminals of the first switch SW1 is connected to the drive signal generating circuit 46 of the main controller 40, and the other terminal is connected to the second switch SW2 and the third switch SW3. The first switch SW1 is set to the connected state while a selected drive signal SDS is supplied, and is set to the disconnected state when detecting a response signal RS from the sensor 110.

The second switch SW2 is a 6-channel analog switch. One of the terminals on one side of the second switch SW2 is connected to the first switch SW1 and the third switch SW3, and the six terminals on the other side are each connected to the electrodes of the sensors 110 of the six cartridges 100*a* to 100*f*. The other electrode of each sensor 110 is grounded. The six cartridges 100*a* to 100*f* are selected in sequence by switching the second switch SW2 in sequence.

The third switch SW3 is a one-channel analog switch. One of the terminals of the third switch SW3 is connected to the first switch SW1 and the second switch SW2, and the other terminal is connected to the amplifier 52. The third switch SW3 is set to the disconnected state when supplying the drive signal DS to the sensor 110, and is set to the connected state by receiving a supply of the ON signals from the switch controller 516 when detecting the response signal RS from the sensor 110.

The amplifier 52 includes an OP amplifier, and functions as a comparator for comparing the response signal RS and a reference voltage Vref, and outputs high signals when the voltage of the response signal RS is the reference voltage Vref or higher and outputs low signals when the voltage of the response signal RS is lower than the reference voltage Vref. Therefore, output signals QC from the amplifier 52 are digital signals including only the high signals and the low signals.

The CPU 41 counts the output signals QC outputted from the amplifier 52, measures the oscillation frequencies of the piezoelectric elements 112, and determines the amount of ink stored in the ink cartridges based on the oscillation frequencies. Accordingly, the CPU 41 displays the result of on a display of the computer 90, so that the user is notified of the ink amount.

A3. Detailed Configuration of Ink Cartridge and Sensor

Figure 5B:
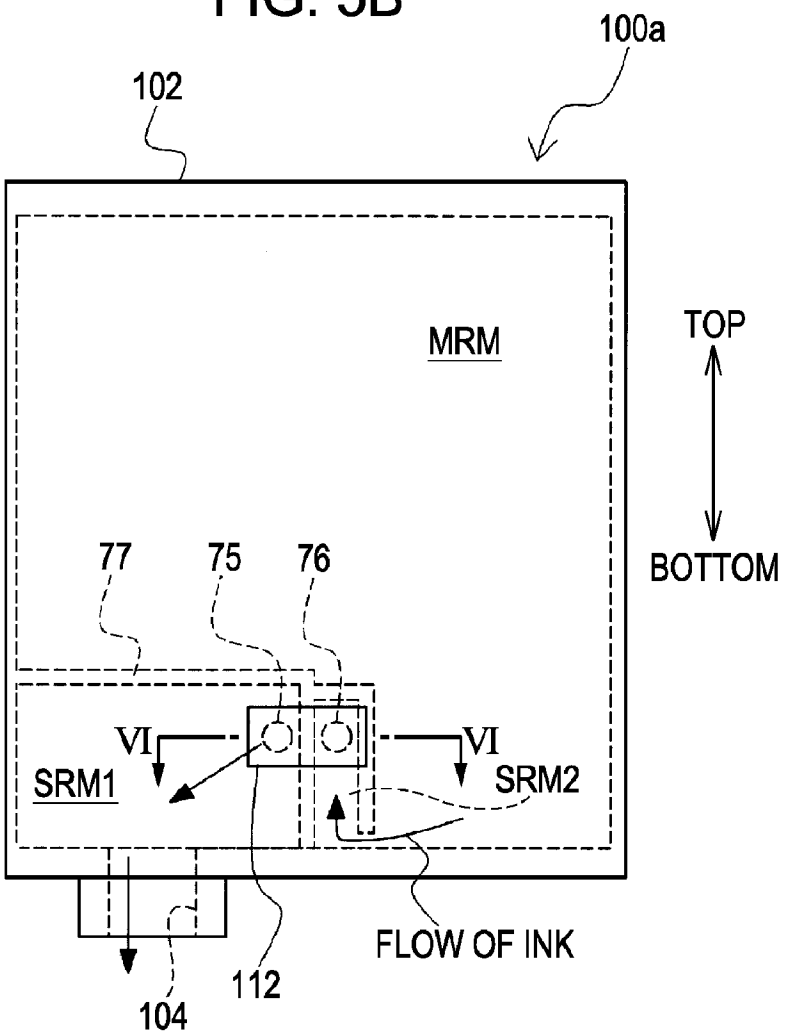
FIG. 5B is an explanatory side view showing the configuration of the ink cartridge according to the first example.
Figure 5A:
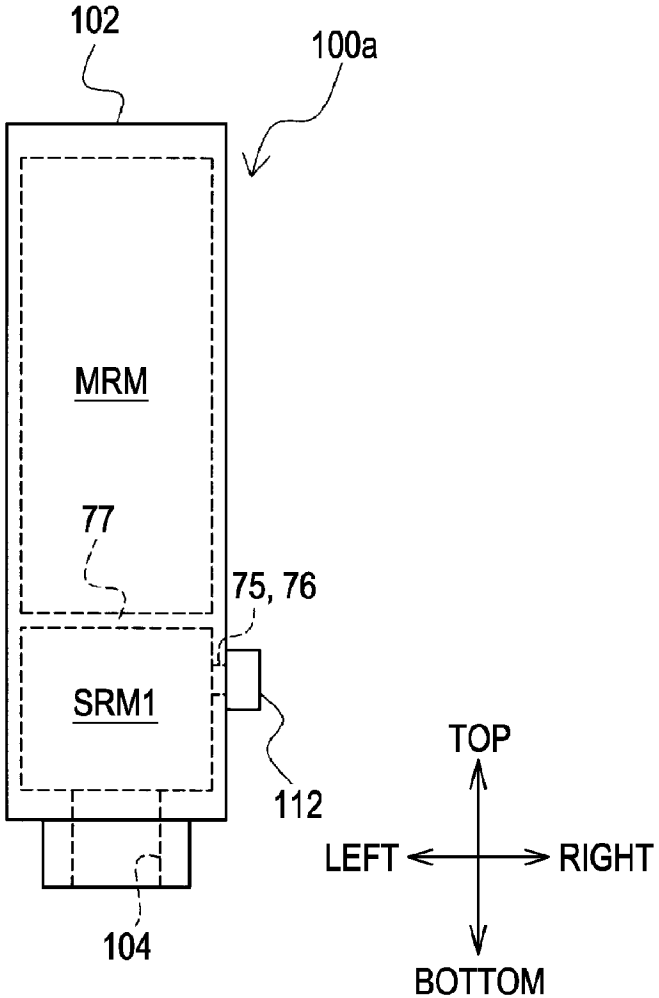
FIG. 5A is an explanatory front view showing a configuration of an ink cartridge according to the first example.
Figure 6A:
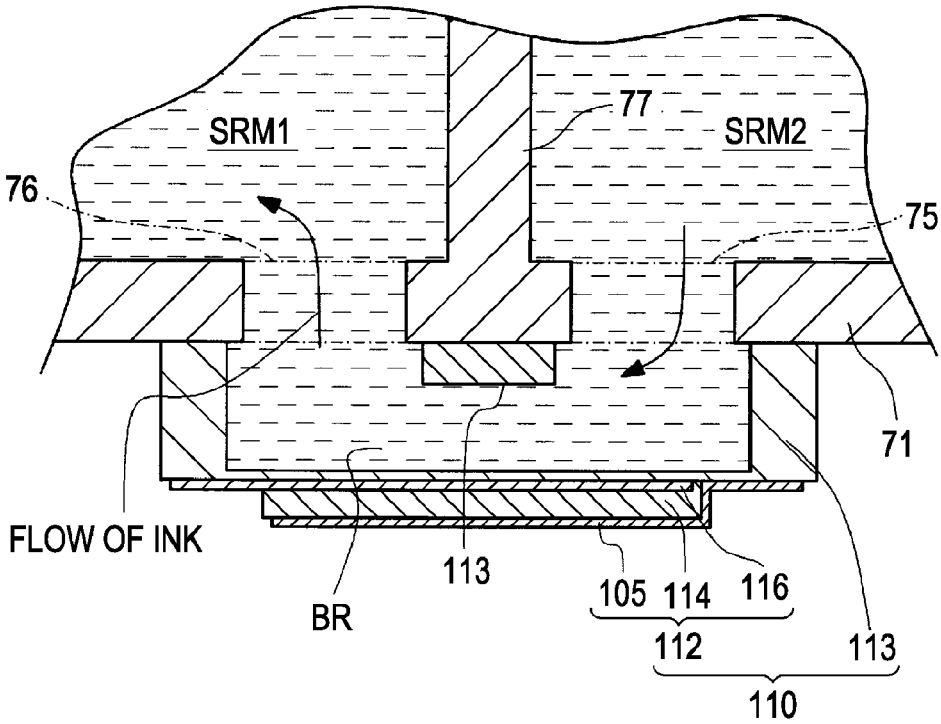
FIG. 6A is an explanatory pattern cross-sectional view of a peripheral portion of a sensor provided on the ink cartridge when ink remains according to the first example.
Figure 6B:
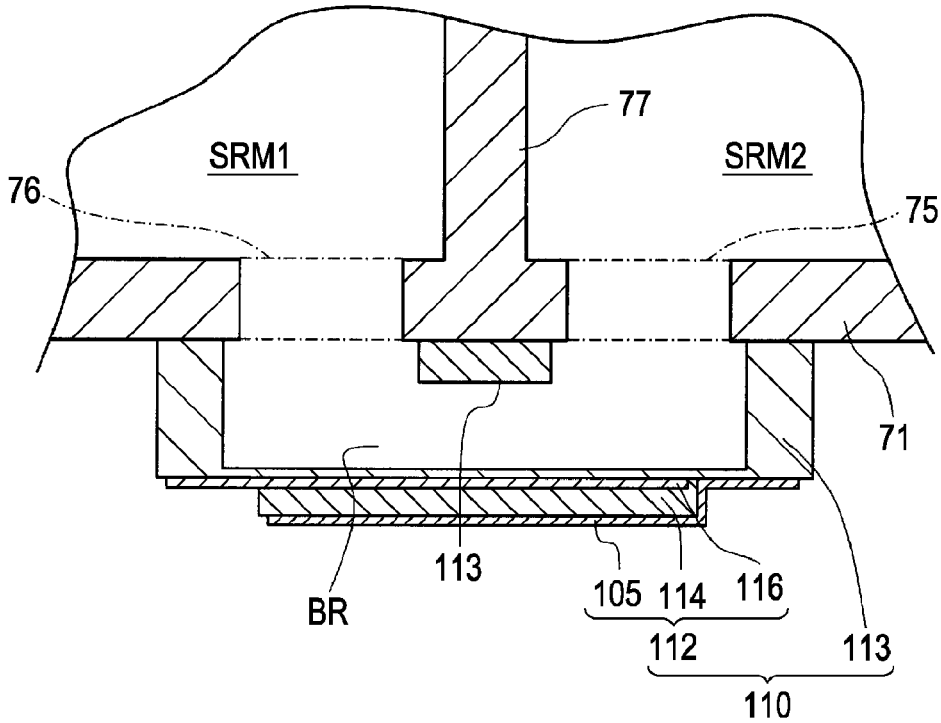
FIG. 6B is an explanatory pattern cross-sectional view of the peripheral portion of the sensor provided on the ink cartridge when ink does not remain according to the first example.

FIGS. 5A-B and FIGS. 6A-B illustrate a detailed configuration of the ink cartridge and the sensor. FIGS. 5A and 5B are a front view and side view of the ink cartridge. FIGS. 6A and 6B are cross-sectional views of a peripheral portion of the sensor located on the ink cartridge.

As shown in FIG. 5A and FIG. 5B, a casing 102 of the cartridge 100*a* includes a plurality of storage chambers for storing ink. A main storage chamber MRM occupies a major portion of a capacity of the entire storage chamber. A first sub-storage chamber SRM1 is in communication with an ink supply port 104, which is located on its bottom surface. A second sub-storage chamber SRM2 is also in communication with the main storage chamber MRM, and is located near the main storage chamber MRM's bottom surface.

FIGS. 6A and 6B are cross-sectional views of a portion of the sensor taken along the line A-A in FIG. 5B, as viewed from above. As shown in FIGS. 6A and 6B, the sensor 110 includes a piezoelectric element 112 and a sensor attachment 113. The piezoelectric element 112 includes a piezoelectric unit 114 and two electrodes 115, 116 on either side of the piezoelectric unit 114, and is installed to the sensor attachment 113. The piezoelectric unit 114 is a ferroelectric substance, and is formed of, for example, PZT (Pb(ZrxTi1-x) O3). Within the sensor attachment 113 a substantially angular C-shaped bridge flow channel BR is formed. A portion of the sensor attachment 113 between the bridge flow channel BR and the piezoelectric element 112 is comprised of a thin film. In this arrangement, a peripheral portion of the piezoelectric element 112 including the bridge flow channel BR oscillates with the piezoelectric element 112.

The ink stored in the cartridge 100*a* flows as indicated by a solid arrow in FIGS. 5A, 5B, 6A, and 6B. More specifically, the ink stored in the main storage chamber MRM flows from the bottom surface area into the second sub-storage chamber SRM2. The ink flowing into the second sub-storage chamber SRM2 flows from a first side hole 76, to the bridge flow channel BR of the sensor attachment 113, through a second side hole 75, and into the first sub-storage chamber SRM1. The ink flowed into the first sub-storage chamber SRM1 passes through the ink supply port 104 and is supplied to the print head unit 60.

FIG. 6A shows the state wherein a predetermined amount of ink remains in the cartridge 100*a* (hereinafter referred to as "remaining ink"). As shown in FIG. 6A, the term "remaining ink" represents the state wherein the ink is in the bridge flow channel BR. That is, the term "remaining ink" represents a state wherein ink exists at a position of the cartridge 100*a* where the sensor 110 is installed (ink detecting position), and the ink is in contact with a portion of the thin film sandwiched between the bridge flow channel BR and the piezoelectric element 112 (ink detecting area) of the sensor attachment 113.

In contrast, FIG. 6B shows the state wherein the ink is less than the predetermined amount (hereinafter referred to as "no remaining ink"). The term "no remaining ink" represents the state wherein the ink is not in the bridge flow channel BR. That is, the term "no remaining ink" represents a state wherein the ink does not exist at the ink detecting position, and the ink is not in contact with the ink detecting area.

A4. Drive Signal

The drive signal with improved detection accuracy of the oscillation frequencies will now be described. As described above, the printer 20 determines the amounts of the ink stored in the cartridges by supplying the drive signal to the piezoelectric elements provided on the cartridges and measuring the frequencies of the response signals outputted from the piezoelectric elements. Therefore, it is desirable to increase the amplitude of the response signals in order to improve the detection accuracy of the oscillation frequencies. Further, it is preferable to adjust the frequency of the drive signal to be equal to characteristic frequencies of the piezoelectric elements 112 in order to improve the detection accuracy of the oscillation frequencies of the response signals. The piezoelectric elements resonate and output response signals with large amplitudes by supplying a drive signal having the same frequency as the characteristic frequencies of the piezoelectric elements to the piezoelectric elements.

Figure 7A:
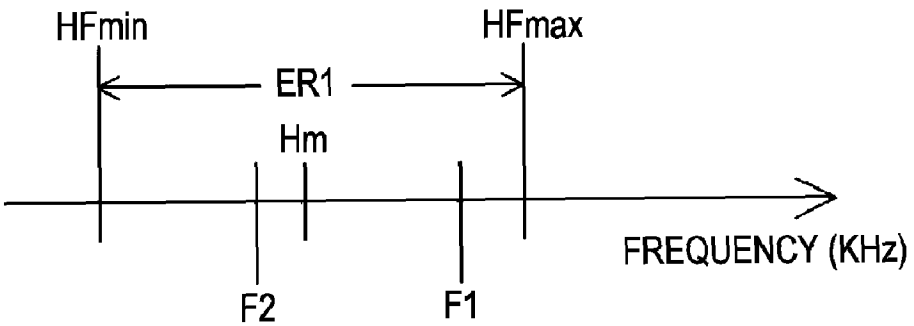
FIG. 7A is an explanatory drawing showing an error range of the characteristic frequency of the cartridge when ink remains according to the first example.
Figure 7B:
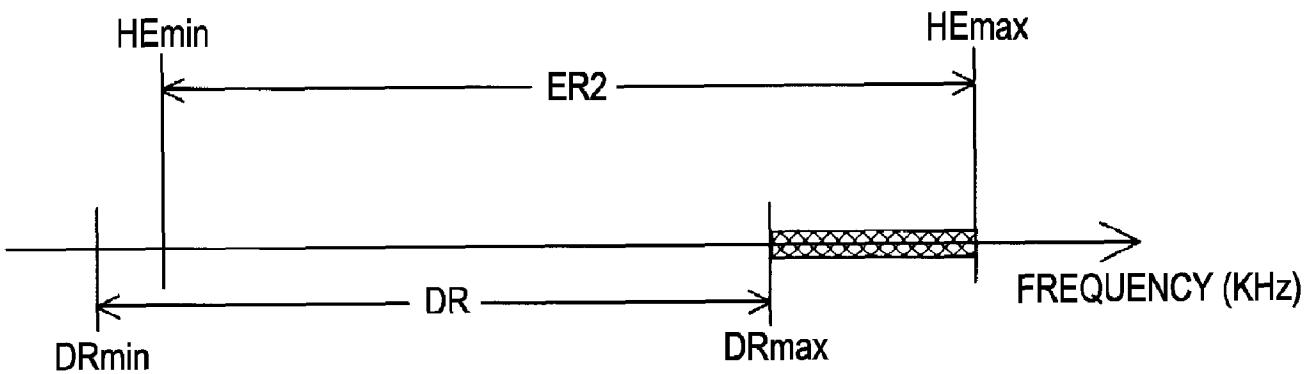
FIG. 7B is an explanatory drawing showing the error range of the characteristic frequency of the cartridge when ink does not remain according to the first example.

However, difficulties arise as the cartridge sensor is subject to the manufacturing errors within the manufacturing process. Therefore, in general, the characteristic frequency fF when ink remains and the characteristic frequency fE when ink does not remain have margins of error with respect to a target characteristic frequencies H1 and H2, respectively. This margin of error will be described using FIGS. 7A and 7B. FIGS. 7A and 7B are drawings showing an exemplary error range of the characteristic frequency of the cartridge. FIG. 7A shows an error range of the characteristic frequency of the piezoelectric element when there is remaining ink in the container, and FIG. 7B shows an error range of the characteristic frequency of the piezoelectric element when there is no ink remaining in the container.

As shown in FIG. 7A, when there is ink remaining in the container, there is an error range ER1 from HFmin (KHz) to HFmax (KHz). On the other hand, as shown in FIG. 7B, when there is no remaining ink, there is an error range ER2 from HEmin (KHz) to HEmax (KHz). As shown in the figures, there is a smaller range of oscillations included in the error range ER2 than in the error range ER1.

The method of generating the response signal when ink does not remain will be described. When the frequency of the drive signal is set to the same frequency as the intermediate frequency Hm of the error range ER1 and is supplied to the piezoelectric element, the characteristic frequency fE of the piezoelectric element of the cartridge is included within the accuracy range of Equation 1 shown below. Hereinafter, the range expressed by the Equation 1 is referred to as a detectable range DR.

$$(\text{drive signal frequency } F*3)\alpha\% \leqq \text{characteristic frequency } fE \leqq (\text{drive signal frequency } F*3)+\alpha\% \qquad \text{Equation 1:}$$

In Equation 1, the value a is an allowable limit of error calculated on the basis of the manufacturing test in the manufacturing process, and is $\alpha=8$ in this example. When the characteristic frequency fE of the cartridge to be processed is included in the detectable range DR (DRmin (KHz) to DRmax (KHz)), the residual oscillation of the piezoelectric element is effectively excited and hence the amplitude of the response signal may be amplified. However, in situations, such as those shown in FIG. 7, when the characteristic frequency fE of the cartridge to be processed is higher than DRmax (KHz) (the hatched range in FIG. 7B) the residual oscillation of the piezoelectric element is not effectively excited, and the detection accuracy of the response signal is lowered.

In order to adjust the frequency of the drive signal to be the same as the characteristic frequency of the piezoelectric element of the cartridge, it is necessary to generate different drive signals every time the ink amount determination process is performed, requiring significant process time.

In order to solve this problem, the printer according to the invention generates and outputs a drive signal including two types of signal waveforms, SP1 and SP2, each having different frequencies. The printer controls the connecting state of the first switch SW1, selects the signal waveform having a frequency closer to the characteristic frequency of the piezoelectric element from between SP1 and SP2, and supplies a drive signal associated with the selected signal waveform to the piezoelectric element. Accordingly, it is not necessary to generate drive signals with differing frequencies for each cartridge to be processed, meaning that a drive signal capable of effectively exciting the residual oscillations of the piezoelectric elements is supplied.

In this example, a waveform of a given frequency F1, which is included in the error range ER1 and is a frequency higher than the intermediate frequency Hm of the error range ER1 is determined to be the first signal waveform SPA, and the waveform of a given frequency F2, which is included in the error range ER1 and is a frequency lower than the intermediate frequency Hm of the error range ER1 is determined to be the second signal waveform SP2.

Figure 8:
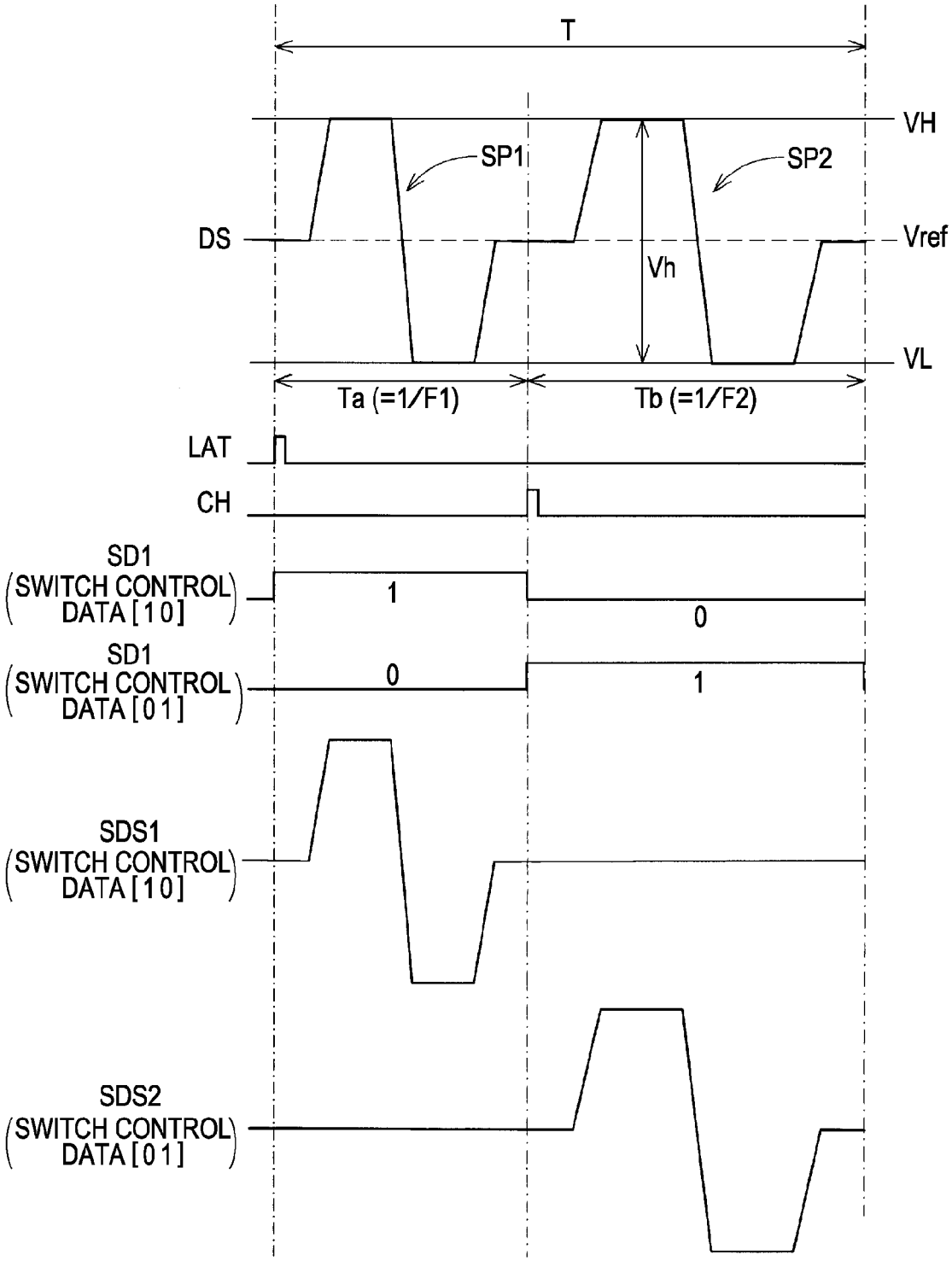
FIG. 8 is a waveform chart showing an example of a pulse waveform of a drive signal according to the first example.

Referring now to FIG. 8, the drive signal DS generated by the drive signal generating circuit 46 will be described. FIG. 8 is a waveform chart showing an outputted drive signal and the selected drive signal SDS to be applied to the piezoelectric elements.

The CPU 41 issues instructions in order to generate the drive signal to the drive signal generating circuit 46 using a drive signal generating parameter stored in the memory 42. The drive signal generating circuit 46 generates the drive signal DS according to the instructions in order to generate a drive signal, which is then issued from the CPU 41. The drive signal generating parameter includes various parameters required for generating drive signal such as a drive voltage Vh, a maximum voltage VH, a minimum voltage VL, a ratio for defining the relation between the drive voltage Vh and the reference voltage Vref, the frequency F1, and the frequency F2.

The drive signal DS includes the first signal waveform SP1 generated during a term Ta and the second signal waveform SP2 generated during a term Tb of a drive signal cycle T. The term Ta is one cycle of the first signal waveform SP1 and follows the equation Ta=1/F1. The term Tb is one cycle of the second signal waveform SP2 and follows the equation Tb=1/F2. The drive signal cycle T (term Ta+term Tb) corresponds to one cycle T of the drive signal DS.

The method of selecting the drive signal waveform of the selected drive signal to be supplied to the piezoelectric element from the first signal waveform SP1 and the second signal waveform SP2 will now be described. The drive signal selecting process is executed by the CPU 41. The characteristic frequency fF is calculated from the error range ER1, the error range ER2, and the characteristic frequency fE, using Equation 2 shown below. The characteristic frequency fE when there is no remaining ink is obtained through a test measurement during the manufacturing process.

$$fF=(fE-HE\text{min})*(HF\text{max}-HF\text{min})/(HE\text{max}-HE\text{min})+HF\text{min} \qquad \text{Equation 2:}$$

The memory 130 includes the characteristic frequency fE of the piezoelectric element when there is no remaining ink, which is stored in advance as frequency information 135. The CPU 41 acquires the characteristic frequency fE from the memory 130 of the cartridge to be processed via the subcontroller 50, and calculates the characteristic frequency fF using Equation 2. When the calculated characteristic frequency fF is higher than the intermediate frequency Hm, the CPU 41 selects the first signal waveform SP1 as a waveform of the selected drive signal, and when the calculated characteristic frequency fF is lower than the intermediate frequency Hm, the CPU 41 selects the second signal waveform SP2 as a waveform of the selected drive signal.

When the selected drive signal comprising the first signal waveform SP1 is supplied to the piezoelectric element, the detectable range DR is calculated using Equation 1. When the characteristic frequency fE of the piezoelectric element of the cartridge when there is no remaining ink is included in the detectable range DR of Equation 1, the residual oscillation of the piezoelectric element is effective. When the characteristic frequency fF when there is ink remaining in the cartridge, is included within the range of "drive signal frequency F±25%", the residual oscillation of the piezoelectric element is effectively excited.

A5. Switch Control Data

The CPU 41 generates the first switch control data SD1 on using the selection process shown above. Referring now to FIG. 9, the first switch control data SD1 will be described. FIG. 9 is an explanatory illustration showing the selection patterns of the selected drive signal and the first switch control data SD1. The selection table 500 shown in FIG. 9 shows selected patterns of the signal waveform together with an association function between the first switch control data SD1 and the characteristic frequency fF. For example, the CPU 41 selects (shown as "0") the first signal waveform SP1 as the waveform of the selected drive signal in the case where the characteristic frequency fF>intermediate frequency Hm. In this case, as shown in FIG. 9, since the first switch control data SD1 is [10], the CPU 41 generates the first switch control data SD1[10]. On the other hand, when the characteristic frequency fF≦intermediate frequency Hm, the second signal waveform SP2 is selected as the waveform of the selected drive signal. In this case, since the first switch control data SD1 is [01], the CPU 41 generates the first switch control data SD1[01] and sends the same to the calculator 51.

A6. Switch Control Signal

The calculator 51 outputs the first switch control signal CS, which controls the connecting state of the first switch SW1 according to the first switch control data SD1 sent from the CPU 41. The waveforms of the switch control signals and the selected drive signals to be applied to the piezoelectric elements will be described in reference to FIG. 8. The selected drive signals shown in FIG. 8 indicate the drive signals to be applied to the piezoelectric elements.

The switch controller 516 outputs the switch control signal CS for controlling ON and OFF of the first switch SW1 on the basis of the latch signal LAT, the change signal CH, and the first switch control data SD1 supplied from the CPU 41. When the switch control signal CS is at a high level, the first switch SW1 is in the connected state. Therefore, as shown in FIG. 8, when the first switch control data SD1 is [10], the switch controller 516 outputs high-level signals (ON signals) over the term Ta, and the first switch SW1 is in the connected state. In contrast, when the switch controller 516 outputs low-level signals over the term Tb, the first switch SW1 is in the disconnected state. Therefore, as shown in the selected drive signal SDS1 in FIG. 8, only the signals having the first signal waveform SP1 are supplied to the piezoelectric elements 112. When the first switch control data SD1 is [01], since the switch controller 516 outputs low-level signals over the term Ta, the switch is in the disconnected state, and the switch controller 516 outputs high-level signals over the term Tb, and the switch is in the connected state. Therefore, as shown in the selected drive signal SDS2 in FIG. 8, only the signals having the second signal waveform SP2 are supplied to the piezoelectric elements 112. Accordingly, a drive signal DS which excites the piezoelectric elements 112 effectively is selected from the two signal waveforms SP1 and SP2.

Figure 10:
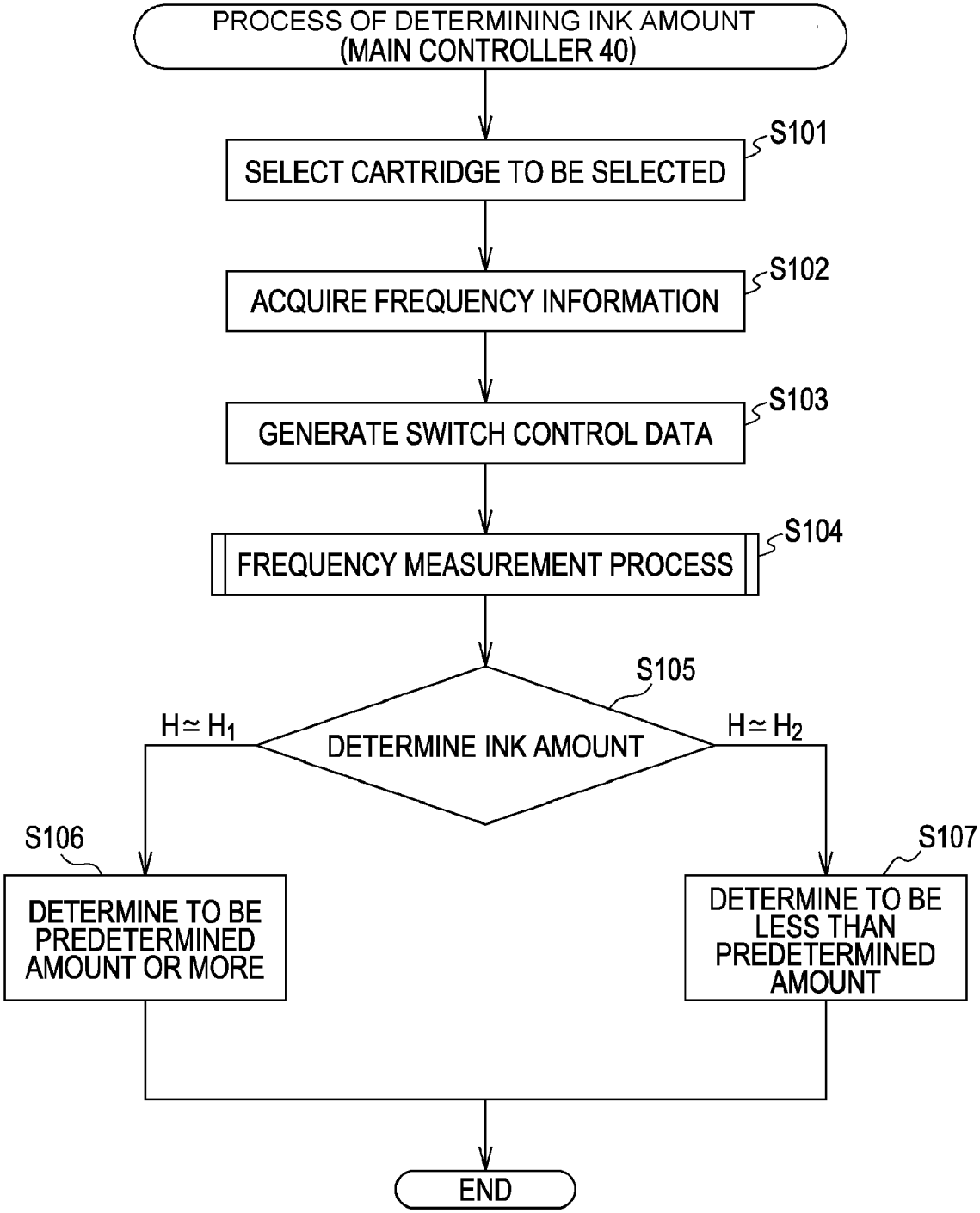
FIG. 10 is a flowchart showing an ink amount determination process according to the first example.
Figure 11:
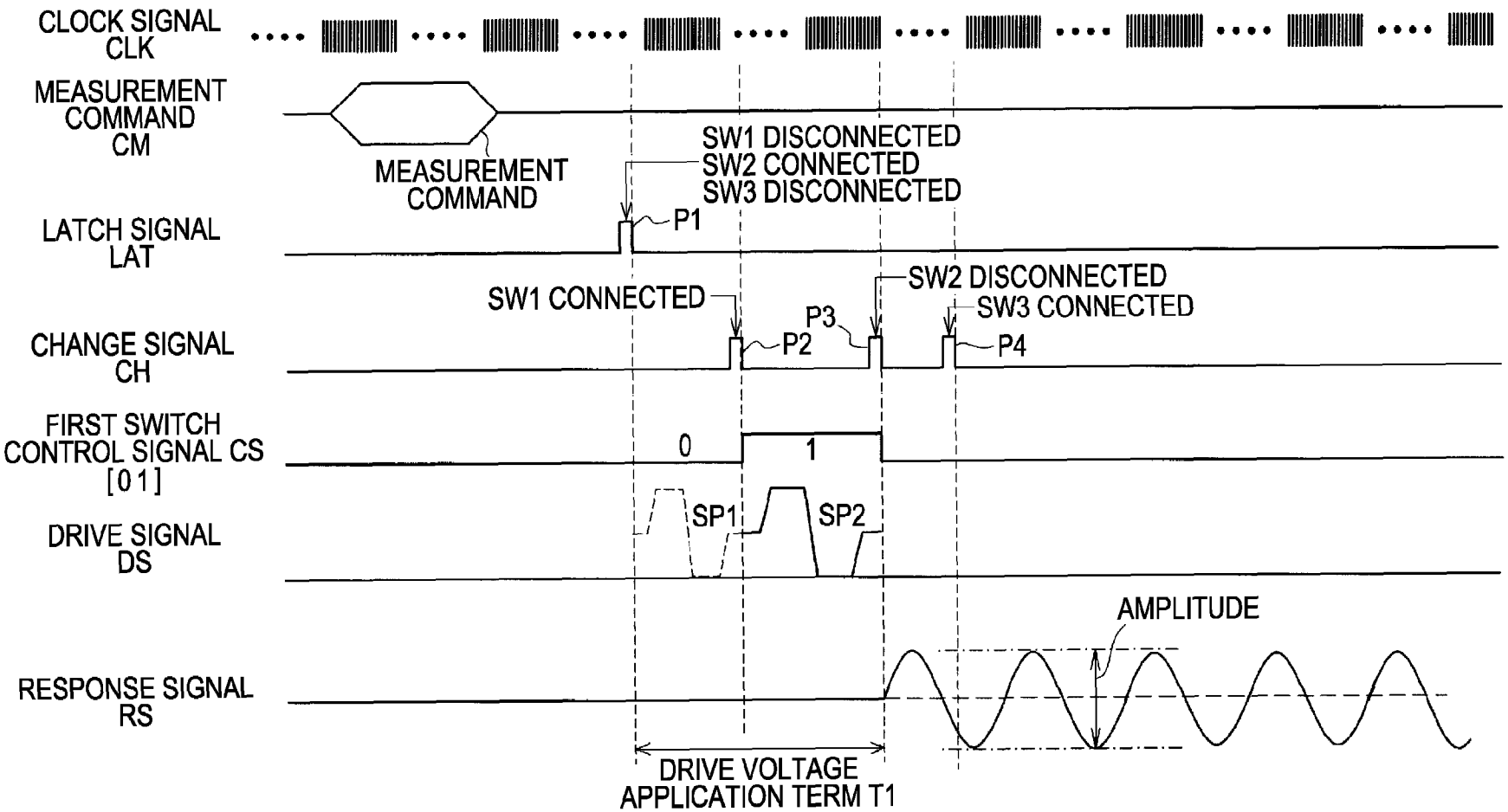
FIG. 11 is a timing chart for explaining a frequency measurement process according to the first example.

A7. Ink Amount Determination Process:

Referring now to FIGS. 10 and 11, the ink amount determination process that the main controller 40 and the sub-controller 50 of the printer 20 execute in cooperation will be described. FIG. 10 is a flowchart explaining the ink amount determination process. FIG. 11 is a timing chart for explaining a frequency measuring process.

The process of determining the ink amount is a process for determining whether the ink amount stored in the cartridge is more or less than a predetermined amount for each cartridge. The process of determining the ink amount is typically executed when the power of the printer 20 is turned ON.

The CPU 41 of the main controller 40 selects a cartridge as a target of the process of determining the ink amount from among the six cartridges 100*a* to 100*f* when the process is started (Step S101).

The main controller 40 acquires the frequency information 135 relating to the characteristic frequency of the piezoelectric element 112 from the memory 130 provided on the target cartridge (Step S102). More specifically, the main controller 40 sends a command for causing the sub-controller 50 to acquire the frequency information 135 stored in the memory 130 of the cartridge, in order to send the information to the calculator 51 of the sub-controller 50. The CPU 511 of the calculator 51 acquires the frequency information 135 and sends the acquired frequency information 135 to the sub-controller 50.

The main controller 40 generates the switch control data for determining the first switch control data SD1 on the basis of the acquired frequency information 135 (Step S103), using the process described above. In this example, the second signal waveform SP2 is selected, and the first switch control data SD1[01] is generated.

The main controller 40 generates the drive signal DS having the first signal waveform SP1 and the second signal waveform SP2 and outputs the same to the piezoelectric element in order to execute the frequency measuring process (Step S105). Referring now to a timing chart shown in FIG. 11, the frequency measuring process will be described. The clock signal CLK, a measurement command CM, the latch signal LAT, and the change signal CH shown in FIG. 11 are signals that may be sent to the calculator 51 of the sub-controller 50 from the main controller 40 in the frequency measuring process. The switch control signal CS is a signal outputted from the switch controller 516. The measurement command CM includes information for specifying the cartridge to be processed together with a command that instructs execution of the frequency measurement process. The drive signal DS is a signal outputted from the drive signal generating circuit 46 of the main controller 40 as described above. The response signal RS is a signal generated in association with the residual oscillation of the piezoelectric element after having supplied the drive signal DS.

The calculator 51 of the sub-controller 50 controls the second switch SW2 according to the measurement command CM which the calculator 51 has received in advance to the timing when the latch pulse P1 of the latch signal was received, and brings the piezoelectric element 112 of the cartridge to be processed into the state of being connected with the sub-controller 50. Furthermore, the calculator 51 controls the connecting state of the first switch SW1 on the basis of the first data of the first switch control data SD1 at the time when the latch pulse P2 is received. In this example, the first switch control data SD1[01] is supplied to the switch controller 516. Since the first data of the first switch control data SD1 is [0], the ON signal is not outputted to the first switch SW1 from the switch controller 516, and hence the first switch SW1 is in the disconnected state. Furthermore, The calculator 51 brings the third switch SW3 into the disconnected state at a timing when the latch pulse P1 is received. Accordingly, the amplifier 52 is electrically disconnected from the drive signal generating circuit 46 and the piezoelectric element 112, and hence the drive signal DS is not applied to the amplifier 52.

The main controller 40 generates a change pulse P2 of the change signal at a timing when the term Ta terminates. The calculator 51 controls the connected state of the first switch SW1 based on the second data of the first switch control data SD1 at the time when the change pulse P2 is received. In this example, since the second data of the first switch control data SD1 is [1], the ON signal is outputted from the switch controller 516 to the first switch SW1. The first switch SW1 is set to the connected state upon reception of the ON signal. Accordingly, only the selected drive signal having the second signal waveform SP2 is applied to the piezoelectric element 112.

The main controller 40 generates a change pulse P3 at the time when the application of the drive signal is terminated. The calculator 51 of the sub-controller 50 brings the first switch SW1 into the disconnected state at the time when the change pulse P3 is received. A term from the latch pulse P1 to the change pulse P3 is referred to as the drive voltage application term T1.

After having terminated the drive voltage application term T1, the piezoelectric element 112 is oscillated by the drive signal. The piezoelectric element 112 outputs a response signal RS according to distortion in association with the oscillation. After having generated the change pulse P3, the main controller 40 generates a change pulse P4. The calculator 51 of the sub-controller 50 brings the third switch SW3 into the connected state at upon reception of the change pulse P4. Consequently, the response signal RS from the piezoelectric element 112 is supplied to the amplifier 52.

The amplifier 52 functions as a comparator as described above, and outputs the output signal QC as a digital signal according to the waveform of the response signal RS to the calculator 51. The calculator 51 calculates an oscillation frequency H of the response signal RS on the basis of the acquired output signal QC and sends the signal RS to the main controller 40.

The main controller 40 determines the amount of ink in the cartridge based on the oscillation frequency H (Step S105). Next, the main controller 40 determines if the amount of ink in the cartridge to be more than the predetermined amount when the oscillation frequency H is compared to the above-described characteristic frequency H1 (Step S106). Similarly, the main controller 40 determines if the amount of ink in the cartridge is smaller than the predetermined amount when the oscillation frequency H is compared to the characteristic frequency H2 (Step S107).

The main controller 40 sends the result of determination of the ink amount to the computer 90. Accordingly, the computer 90 may notify the result of determination of the received ink amount to the user.

In the printing system of this invention, the drive signal has a plurality of signal waveforms with different frequencies. The plurality of signal waveforms are outputted and one is selected to form a drive signal according to the characteristic frequency of each ink cartridge, so that a selected drive signal includes only the selected signal waveform is supplied to the piezoelectric element. Therefore, in the ink amount determination process, it is no longer necessary to regenerate the drive signal for each cartridge, alleviating the processing load of the printing apparatus, and reducing the processing time of the process.

Since it is not necessary to configure a circuit individually for each signal waveform in order to generate the plurality of signal waveforms, the circuit required to execute the process of determining the amount of ink is simplified.

In accordance with one embodiment of the invention, the drive signal which is used to oscillate the piezoelectric element is selected from a first signal waveform SP1 and a second signal waveform SP2, there is improved accuracy in detecting the response signal, and the accuracy of the ink amount determination is improved.

B. Second Example

In the example described above, one shot (one cycle) each of the first signal waveform SP1 and the second signal waveform SP2 are included in one cycle of the drive signal DS. In the second example, for example, two shots (two cycles) each of the signal waveforms may be included.

B1. Waveform of Drive Signal

Figure 12:
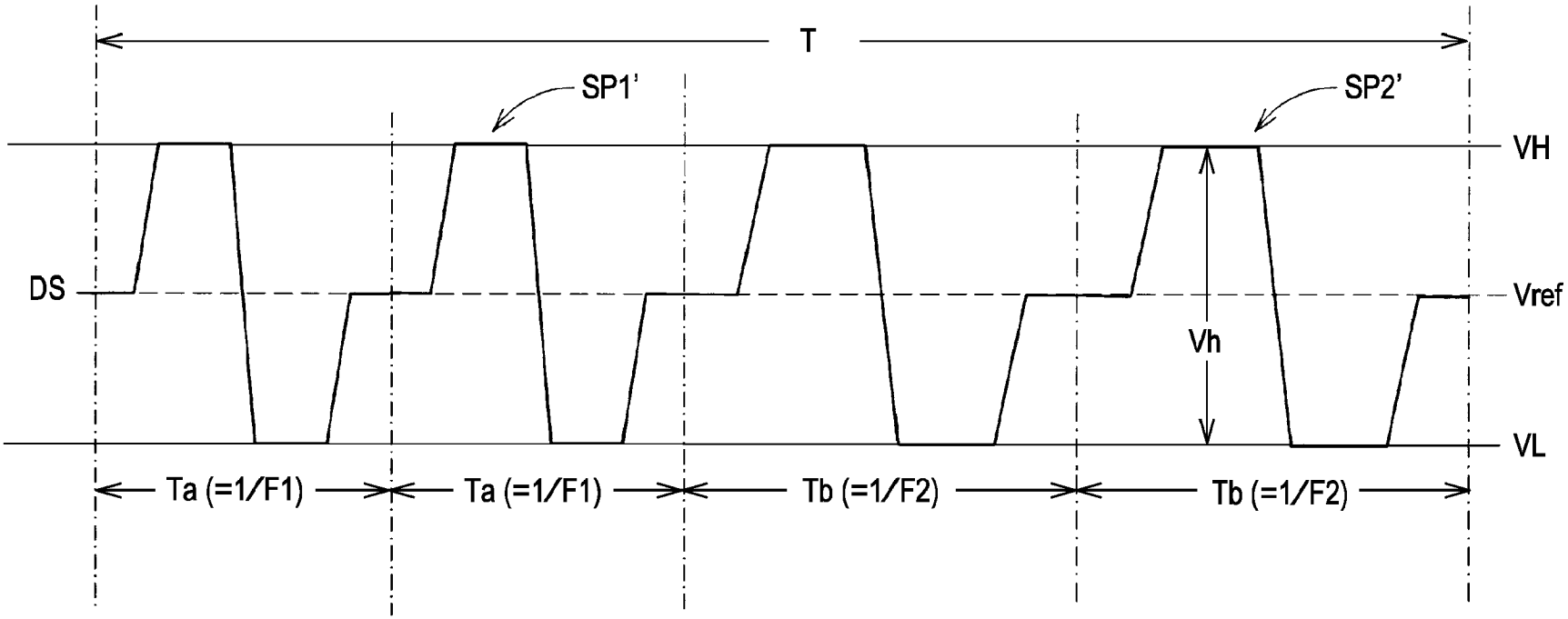
FIG. 12 is a waveform chart showing an example of a pulse waveform of a drive signal according to a second example.

FIG. 12 is a waveform chart showing a drive signal DS' according to the second example. The drive signal DS' is a signal outputted from the drive signal generating circuit 46. Within the drive signal generating circuit 46, a first signal waveform SP1' and a second signal waveform SP2' containing the waveforms for two cycles respectively are included in the drive signal cycle T of the drive signal DS' as shown in FIG. 12. The term Ta indicates one cycle T of the signal at the frequency F1, and the term Tb indicates one cycle of the signal at the frequency F2.

In this example, when the first signal waveform SP1 is selected as a waveform of the selected drive signal, only the first signal waveform SP1' including the waveforms for two cycles is supplied to the piezoelectric element, and the second signal waveform SP2' is not supplied to the piezoelectric element.

The piezoelectric element is excited in order to create a residual oscillation with a large amplitude in association with the increase in number of cycles (number of shots) of the waveform, resulting in improved detection accuracy of the response signal. However, this example results in increased processing time, in association with increase in number of shots of the waveform to be supplied to the piezoelectric element. Therefore, the waveform of the selected drive signal is preferably two shots or smaller. Accordingly, the amplitude of the oscillation of the piezoelectric element 112 is increased, the detection accuracy of the response signal is further improved, and the processing time is reduced.

As shown in FIG. 12, the numbers of shots included in the first signal waveform SP1' and the second signal waveform SP2' are preferably the same. This allows response signals of the same level to be detected at a high degree of accuracy irrespective of which one of the first signal waveform SP1' and the second signal waveform SP2' is supplied to the piezoelectric element.

C. Modification

In the examples described above, the drive signal having the waveforms at the two different frequencies are generated from within the error range ER1 of the characteristic frequency when ink remains in the cartridge. However, it is also possible to generate the drive signal having a waveform of the drive signal for executing the ink amount determination process both when there is ink remaining in the cartridge and when there is no ink remaining in the cartridge. In this configuration, it is not necessary to regenerate the drive signal during the ink amount determination processes when ink remains in the cartridge and when ink does not remain in the cartridge, and hence the processing time may be preferably reduced. Since it is not necessary to configure the circuit for generating the drive signal to be used when executing the each of the processes for determining the ink amount, the circuit size may be reduced.

Although various examples of the invention have been described thus far, the invention is not limited to the examples shown above and, needless to say, various configurations may be employed without departing the scope of the invention.

What is claimed is:

1. A printing apparatus to which a printing material container is detachably mounted, the printing material container having a piezoelectric element for detecting the amount of printing material stored in the printing material container and a memory unit storing frequency information on natural vibration frequency of the piezoelectric element, the printing apparatus comprising:

means for acquiring the frequency information from the memory unit;

means for generating a drive signal which has a first signal waveform at a first frequency and a second signal waveform at a second frequency which is different from the first frequency;

means for selectively supplying either the first signal waveform or the second signal waveform to the piezoelectric element so as to increase the amplitude of the vibrations of the piezoelectric element;

means for detecting a response signal outputted in response to vibration of the piezoelectric element;

means for measuring the vibration frequency of the piezoelectric element contained in the response signal; and means for determining the amount of printing material stored in the printing material container based on the measured vibration frequency.

2. The printing apparatus according to claim 1, wherein the means for generating the drive signal generates and outputs the drive signal with the first signal waveform and the second signal waveform in a series.

3. The printing apparatus according to claim 1, wherein the means for selectively supplying comprises:

a supply control information generating unit which generates supply control information relating to the selected drive signal based on information relating to the drive signal frequency; and a supply control unit capable which supplies the selected drive signal to the piezoelectric element on the basis of the supply control information.

4. The printing apparatus according to claim 3, further comprising:

a first terminal located within the printing material storage container which is electrically connected to the printing apparatus, a second terminal to be connected to the first terminal; and a connecting portion located in the means for selectively supplying for connecting the drive signal generating unit and the second terminal;

wherein the mean for selectively supplying controls the connecting state of the connecting portion based on the supply control information.

5. The printing apparatus according to claim 1, wherein the first signal waveform includes at least two cycles of waveform and the second signal waveform includes at least two cycles of waveform.

6. The printing apparatus according to claim 5, wherein the number of waveform cycles included in the first and second waveform signal are the same.

7. A method of determining the amount of printing material executed by a printing apparatus configured to dismountably mount a printing material storage container having a piezoelectric element for detecting the amount of stored printing material and a memory in which frequency information relating to the characteristic frequency of the piezoelectric element is stored, comprising:

acquiring the frequency information from the memory;

generating and outputting a drive signal used for driving the piezoelectric element and having a first signal waveform at a first frequency and a second signal waveform at a second frequency which is different from the first frequency;

selecting a waveform which increases the amplitude of oscillations of the piezoelectric element from the first signal waveform and the second signal waveform of the outputted drive signal on the basis of the frequency information and supplies a selected drive signal having the selected signal waveform exclusively to the piezoelectric element;

detecting a response signal outputted in association with the oscillation of the piezoelectric element after having stopped the supply of the selected drive signal;

measuring the oscillation frequency of the piezoelectric element included in the response signal; and determining the amount of the printing material stored in the printing material storing container on the basis of the oscillation frequency.

8. A printing apparatus to which a printing material container is detachable mounted, the printing material container having a piezoelectric element for detecting the amount of printing material stored in the printing material storage container and a memory unit storing frequency information on natural vibration frequency of the piezoelectric element, the printing apparatus comprising:

means for acquiring the frequency information from the memory unit;

means for generating a drive signal which has a first signal waveform at a first frequency and a second signal waveform at a second frequency which is different from the first frequency, and where the means for generating the drive signal transmits the waveforms in series;

means for selectively supplying either the first signal waveform or the second signal waveform to the piezoelectric element so as to increase the amplitude of the vibrations of the piezoelectric element;

means for detecting a response signal outputted in response to vibration of the piezoelectric element;

means for measuring the vibration frequency of the piezoelectric element contained in the response signal;

means for determining the amount of printing material stored in the printing material container based on the measured vibration frequency; and means for displaying the amount of material stored in the printing material container to a user.

* * * * *